United States Patent [19]

Tanaka et al.

[11] 4,002,011

[45] Jan. 11, 1977

[54] HIGH SPEED BINDING DEVICE

[75] Inventors: Shigenobu Tanaka, Higashi-Ooizumi; Seiichi Nishikawa, Chiba; Seiji Ishikawa, Fujinomiya, all of Japan

[73] Assignee: The Fujikura Cable Works, Limited, Tokyo, Japan

[22] Filed: Nov. 28, 1975

[21] Appl. No.: 636,202

[52] U.S. Cl. ..... 57/15; 57/6; 57/160

[51] Int. Cl.[2] ..... D07B 3/04

[58] Field of Search ..... 57/3, 6, 13, 14, 15, 57/34 R, 160, 9

[56] References Cited

UNITED STATES PATENTS

| | | | |
|---|---|---|---|
| 1,943,716 | 1/1934 | Bardsley | 57/13 X |
| 2,672,722 | 3/1954 | Shulver et al. | 57/15 |
| 3,130,754 | 4/1964 | Bratz | 57/13 UX |
| 3,667,203 | 6/1972 | Koschatzky | 57/15 |
| 3,949,543 | 4/1976 | Bittman | 57/34 R |

*Primary Examiner*—Donald E. Watkins
*Attorney, Agent, or Firm*—Thompson, Birch, Gauthier & Samuels

[57] ABSTRACT

Disclosed is a high speed binding device wherein a package wound with a binding thread is fixed to a flange of a flyer with its thread-winding axis in parallel with the rotation axis of said flyer and the binding thread is drawn out in the direction of the winding axis; and thereafter said binding thread is passed through a first tensioner for imparting to the binding thread a back tension decreased with a rise in the rotation speed of the flyer and then through a second tensioner for imparting to the binding thread a back tension increased with a rise in said rotation speed, thereby to cause said decrease in the back tension to be offset by said increase in the back tension, thus to bind, with a substantially constant back tension, the binding thread about the outer periphery of an element assembly passing through a through hole coaxially bored through the flyer.

10 Claims, 3 Drawing Figures

A
B
C
D
X
X
26
42
44
44
78
80
82
84
86
86
88
90
92
94
95
96
98
100
101
102
104
106
108
108
108
110
112
114
116
118
120
122
124
126
128
130
132
134
136
138
140
140
142
142
144
146
148
150
152
153
154

HIGH SPEED BINDING DEVICE

This invention relates to a binding device which comprises a flyer including a cylinder extending in the direction of the rotation axis of the flyer and a flange formed thereon at right angles to the cylinder, a plurality of package holders mounted on the flange of the flyer and each having a package having a wound binding thread, means provided on said cylinder for each of said package holders for imparting a back tension to the binding thread being bound about an element assembly moving through a through hole coaxially bored through the flyer, and a binding die for applying the binding thread to the element assembly in cooperation with the rotation of the flyer.

Conventionally, in order to manufacture a multiconductor communication cable a binding device was employed in which, when first assembling elements such as pairs and quads to form an element layer, that is, a primary element assembly and sequentially laying elements on said primary element assembly to form a secondary element assembly, tertiary element assembly, . . . thus to finally form a stranded unit, a binding thread is bound about said primary, secondary, tertiary, . . . element assembly and said stranded unit.

In the above-mentioned conventional binding device, the package having a wound binding thread is fitted to the flange of the flyer with a binding thread-winding axis of the package in parallel to the rotation axis of said flange, so as to be rotated relatively to said flange. The binding thread is drawn out in a direction perpendicular to the binding thread-winding axis of the package, from the package usually so braked as to give a back tension to the binding thread, and is directionally changed through an angle of about 90° so as to be made parallel to the rotation axis of the flyer, and in sequence is bound about the outer periphery of said element assembly. In this case, in order to draw the binding thread out of the package, it is necessary to rotate the above braked package about its axis and to directionally change the binding thread as mentioned above. The binding thread, therefore, must be given a tension superior to or greater than a sum of a frictional force following the rotation of the package and a frictional force following said directional change of the binding thread, said tension being increased with a rise in the rotation speed of the flyer, accordingly, in the drawing-out speed. In addition, this tension value is extremely great in the case where the flyer is subjected to high speed-rotation. As a result, as the binding thread a filament yarn could not be used and even a single yarn could not usually be used, either. Accordingly, a thread prepared by twisting together a plurality of filament yarns had to be used as the binding thread. In the conventional binding device, therefore, even in the case where there is no need to bind so strong a binding thread about the element assembly, an unnecessarily strong binding thread had to be used, or alternatively the rotation speed of the flyer had to be limited for the reason why a relatively strong force is required to draw out the binding thread from the package. The conventional binding device, therefore, had the drawback that it is low in productivity.

Further, in the case of applying the binding thread to the element assembly, it is necessary to impart a uniform or constant back tension to the binding thread. In a tensioner used in the conventional binding device, however, the back tension given by such tensioner is increased or decreased with a variation in the rotation speed of the flyer, which results in a drawback that application of the binding thread with a uniform back tension is impossible.

The object of the invention is to provide a high speed binding device which eliminates the above-mentioned drawbacks accompanying the conventional binding device, and, even in the case where the flyer is rotated at high speed, for example, at a speed for 3000 RPM or more, permits the use as a binding thread, of a vegetable filament yarn or single yarn, or of other extremely fine threads made of animal, mineral or synthetic fibre, and enables the binding thread to be bound about the element assembly with a substantially uniform back tension.

To achieve the above object, the high speed binding device of the invention is provided with a package-attaching mechanism fixed to the flyer with a binding thread-winding axis of the package of each said package holder in parallel to the rotation axis of the flyer, and means for imparting a substantially uniform back tension to each binding thread irrespective of the variation of the rotation speed of the flyer, including a first tensioner for imparting to each binding thread a back tension which is decreased with a rise in the rotation speed of the flyer and a second tensioner for imparting to each binding thread a back tension which is increased with a rise in the rotation speed of the flyer so as to cancel said decreased amount of back tension.

According to the high speed binding device of the invention, each binding thread is drawn out with a relatively small force in parallel to the winding shaft of each corresponding package, said force being maintained substantially constant regardless of the speed at which the binding thread is drawn out of the package, so that even a fine and weak thread such as a filament yarn or single yarn can be used as the binding thread.

If the package-attaching mechanism of the binding device is so constructed as to include a nut, an attaching member having a male screw at one end and a threaded hole at the other end and fixed to the flange of the flyer in parallel to the rotation axis of the flyer by screwing said nut over said male screw, and a screw screwed into said threaded hole so as to fix the package fitted over said other end of said attaching member, said package can be readily attached to the flyer.

Further, if the first tensioner is so constructed as to include a stationary plate fixedly attached to the flyer, a movable plate pressed against the stationary plate from outside toward the center of the flyer, and a spring for pressing the movable plate against the stationary plate, whereby the binding thread is allowed to travel between said movable and stationary plates, the binding thread is given a frictional force by the movable and stationary plates, that is to say, is given a back tension as resulting from this frictional force. Further, if the second tensioner is so constructed as to include a plate member provided substantially radially projectively from the cylinder of the flyer in parallel to the rotation axis of the flyer and a plurality of rods projecting from said plate member at right angles thereto and in the same direction, whereby the binding thread is stretched over said rods in a zigzag manner to be drawn out, a frictional force as resulting from the sliding of the binding thread on said rods is applied to the binding thread thus to act as a back tension. The back tension given by the first tensioner is decreased when the rotation speed of the flyer is, for example, increased. The reason is that a centrifugal force acting on the movable plate is increased with a rise in the rotation speed of the flyer and the movable plate is radially moved against the force of a spring urging the movable plate itself to the stationary plate, so that the binding threadurging force, accordingly the frictional force applied to the binding thread is decreased. Further, the back tension given by the second tensioner is increased with a rise in the travel speed of the binding thread due to a rise in the rotation speed of the flyer. The reason is that when the travel speed of the binding thread is increased, a force with which the binding thread presses the sliding surface of each rod is increased with the result that a frictional force applied to the binding thread becomes great.

Since the binding thread is bound about the element assembly after passing sequentially through the first and second tensioners, the variations in the back tensions given respectively by the first and second tensioners due to the variation in the rotation speed of the flyer offset each other, so that the back tension applied to the binding thread is kept substantially constant regardless of the rotation speed of the flyer.

This invention can be more fully understood from the following detailed description when taken in conjunction with the accompanying drawings, in which.

Figure 1:
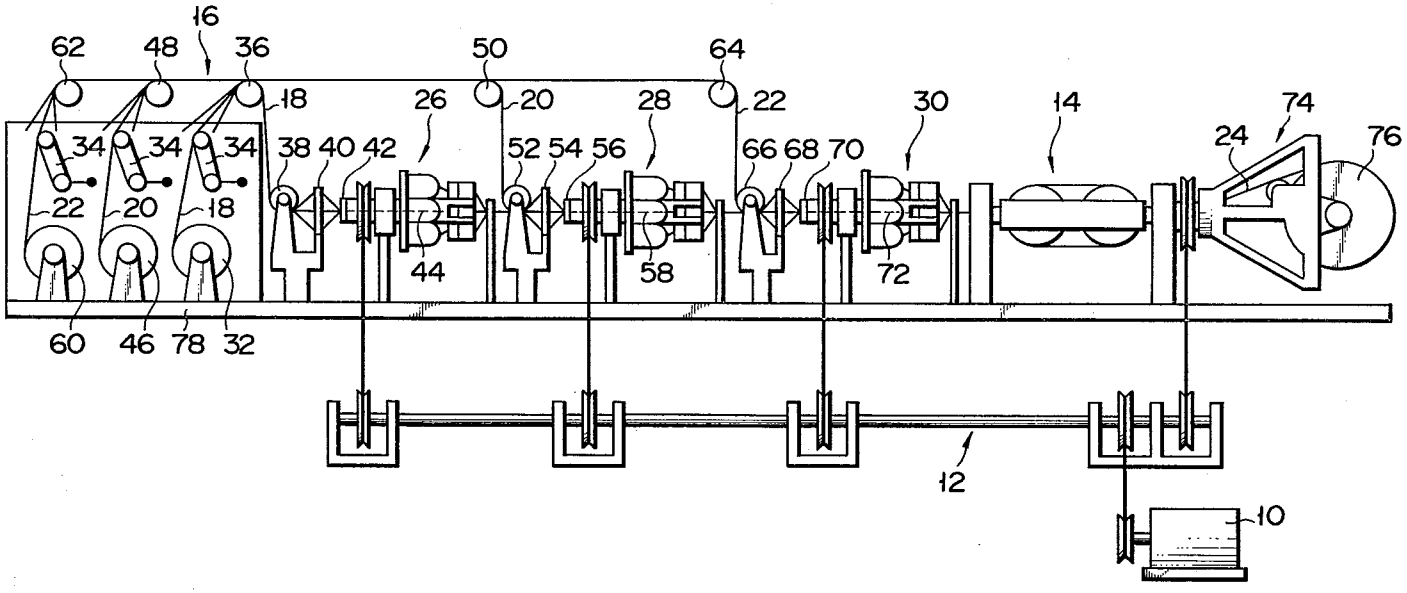
FIG. 1 is a view for explaining a stranding machine using high speed binding devices according to the invention.

FIG. 1 shows a stranding machine operated by a driving mechanism 12 driven by an electric motor 10, for producing a stranded unit 24 from a number of elements 18, 20, 22 (in this embodiment, quads) drawn out of a pay off device 16 by a rotary capstan 14. High speed binding devices 26, 28 and 30 according to the present invention used in the stranding machine are for the purpose of applying a binding thread to the outer periphery of each of three layers (central layer, intermediate layer and peripheral layer consisting individually of quads) consituting the stranded unit 24.

The operation of the above-mentioned stranding machine is hereinafter explained. Elements or quads 18 drawn respectively out of a plurality of bobbins 21 (for simplification of the illustration only one bobbin is shown), after passing through a tension control device 34 and guide pullies 36, 38, are passed through a face plate 40, and are converged and stranded by a convergence die 42 to be formed into the central layer, that is, a primary element assembly 44. After this primary assembly 44 has been subject to application of binding thread by the first high speed binding device 26, it is guided to the second high speed binding device 28.

Elements or quads 20 drawn respectively out of a plurality of bobbins 46 (for simplification of the illustration only one bobbin is shown), after travelling through the tension control device 34 and guide pullies 48, 50, 52, are passed through a face plate 54 and are stranded by a convergence die 56 onto the outer periphery of the primary element assembly 44 (this element assembly is already subject to application of binding thread) to form said intermediate layer (quads) 20. A secondary element assembly 58 thus formed is subject to application of binding thread by the second high speed binding device 28 and then is sent to the third high speed binding device 30.

Elements or quads 22 drawn respectively out of a plurality of bobbins 60 (for simplification of the illustration only one bobbin is shown), after travelling through the tension control device 34 and guide pullies 62, 64, 66, are passed through a face plate 68 and are stranded by a convergence die 70 onto the outer periphery of the secondary element assembly 58 (this assembly is already subject to application of binding thread) to form said peripheral layer of quads. A tertiary element assembly 72 thus formed is subject to application of binding thread by the third high speed binding device 30 and then is taken up onto a bobbin 76 of a take up device 74 through the rotary capstan 14. A product taken up onto the bobbin 76 is said stranded unit 24 as a final product obtained by this stranding machine.

Figures 2, 3:
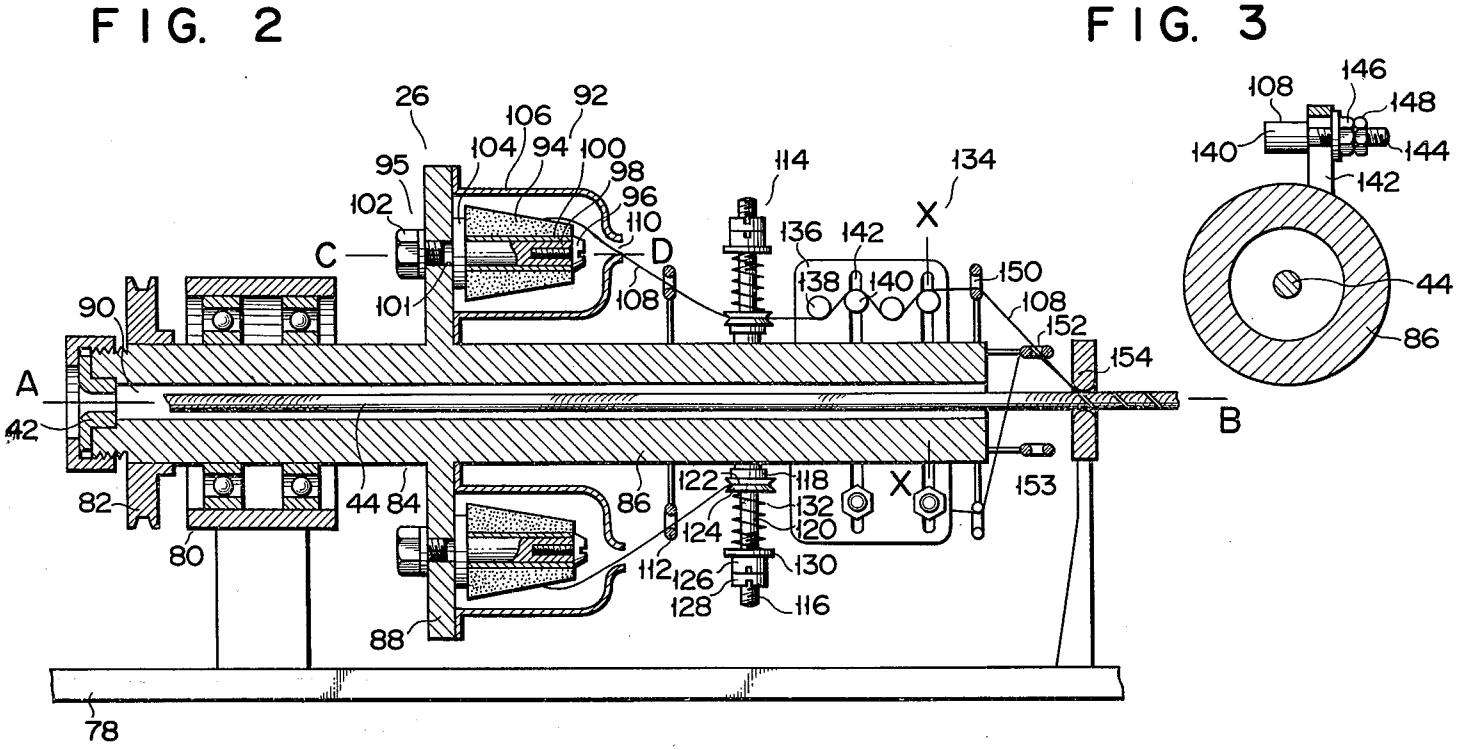
FIG. 2 is a sectional side view of the high speed binding device of FIG. 1.
FIG. 3 is a sectional view taken along line X-X of FIG. 2.

The high speed binding device of the invention is now explained. Through the three high speed binding devices 26, 28 and 30 are employed in the stranding machine of FIG. 1, all of these binding devices have similar construction and action. In the following description, explanation is made mainly of the first high speed binding device 26. Referring to FIGS. 1 and 2, the first high speed binding device 26 is supported by a ball bearing 80 mounted on a base board 78 and has a flyer 84 rotated by a pulley 82 connected to the driving mechanism 12 of FIG. 1. The flyer 84 has a cylinder 86 extending coaxially with a rotation axis AB and a flange 88 formed at right angles to the rotation axis AB. The cylinder 86 is formed with a through hole 90 coaxially with the rotation axis AB, and through this through hole 90 the primary element assembly 44 is allowed to travel from the upstream side A toward the down stream side B.

On the downstream side from the flange 88, that is to say, on the side of B a plurality of package holders 92 are mutually equidistantly attached to the flange 88 concyclically about the rotation axis AB, and in each of these package holders 92 a package 94 having a sleeve 100 and a binding thread layer thereabout is fixed in a manner that its axis being wound with a binding thread 108, that is to say, a thread-winding axis CD is directed in parallel with the rotation axis AB of the flyer 84. Fixation of the package 94 is effected by a package-attaching mechanism 95. This mechanism 95, in this embodiment, includes an attaching member 98 having an attaching flange 104 at its intermediate portion and having a tip end portion passed through an attaching hole 101 bored in the flange 88 and allowed to project leftwardly of the flange 88, a nut 102 for fixing the attaching member 98 to the flange 88, and a screw 96 screwed into a threaded hole formed in the tip end portion of that portion of said attaching member 98 which is extended toward the right side of the attaching flange 104, and intended to fix the package 94 inserted over said rightwardly extended portion so as to prevent this package 94 from being rotated relatively to the attaching member 98, accordingly, to the flange 88. The tip end portion of the binding thread is bound about the primary element assembly 44, and therefore through rotating the flyer 84 and allowing the element assembly 44 to travel in the AB direction by the rotary capstan 14 (see FIG. 1), the resulting binding thread is drawn out from the package 94. The package holder 92 is provided with a cover 106 for covering the package 94. The cover 106 protects the binding thread 108 wound around the package 94, and prevents so following as to contact with other parts, of the binding thread 108 drawn out due to the wind acting on the package 94 because of rotation of the flyer 84, and so acts as to smoothly exteriorly guide the binding thread 108 through an opening 110 provided substantially in a CD axial direction of the package 94. A layer of binding thread as constituting the package 94 is outwardly centrifugally biased by the rotation of the flyer 84 and the travel of the element assembly 44, and therefore if the distance between the cover 106 and the package 94 is made great and said opening 110 is provided outwardly form the CD axis, it would offer a convenience in smoothly drawing out the binding thread 108 exteriorly of the cover 106. This would be particularly effective where the flyer 84 is rotated at high speed. FIG. 2 shows the case where the opening 110 is properly outwardly displaced. Since the binding thread 108 is drawn out in the CD axial direction with the package 94 prevented from being rotated relatively to the flyer 84 as above described, this drawing or pulling operation only requires a small force, and yet this drawing force is kept substantially constant even when the flyer rotation speed, accordingly the binding thread-drawing speed is increased. Therefore, not only a single yarn but also a filament yarn can be used as the binding thread 108. Although in FIG. 2 a conical package 94 is shown, this invention is not limited thereto but a usual package whose contour is cylindrical can be used. The binding thread 108 drawn out from the package holder 92 is guided to a first tensioner 114 through the guide ring 112. The first tensioner 114 is substantially radially projectively provided on the cylinder 86 of the flyer 84, and is equal in number to the package holders 92.

The first tensioners 114 are each fixed at one end to the cylinder 86 by welding, screwing, etc. and each have a substantially radially projecting rod member 120 having a threaded portion 116 at its tip end and a stepped portion 118 in the proximity of its fixed end. A stationary plate 122 is fixed to the stepped portion 118 and a movable plate 124 slidably inserted over the rod member 120 is pressed by a spring 132 against said stationary plate 122. The spring 132 is disposed between the stationary plate 122 and an adjusting plate 130 positioned by a nut 126 and lock nut 128 screwed over the threaded portion 116. Accordingly, the force with which the movable plate 124 is pressed against the stationary plate 122 is varied by adjusting the position of the adjusting plate 130. After passing through the guide ring 112, the binding thread 108 is passed between the stationary plate 122 and the movable plate 124 guided to a second tensioner 134. The binding thread 108, when passed between 122 and 124, is pressed by a force obtained by subtracting a centrifugal force acting on the movable plate 124 due to the flyer rotation from a compression force of the spring 132. A frictional force is produced, due to this pressing force, between the travelling binding thread 108 and each of the plates 122, 124. This frictional force is given as a back tension for the binding thread 108 in the case where this binding thread is applied to the outer periphery of the primary element assembly 44 travelling through the hole 90. When the rotation speed of the flyer 84 is constant, a centrifugal force acting on the movable plate 124 is constant. At this time, therefore, the first tensioner 114 imparts a constant back tension to the binding thread 108. However, where the flyer rotation speed is increased, said centrifugal force is increased and the pressing force between both plates 122 and 124 is decreased. As a result, the first tensioner 114 gives a resulting reduced back tension to the binding thread 108. Accordingly, where the flyer rotation speed is liable to fluctuate for some reason or other, the value of said back tension is varied to fail to cause an application of the binding thread with a uniform back tension. Further, also where the flyer rotation speed is so varied as to have various desired values, it becomes necessary to readjust the degree of zigzagging the binding thread 108 in the following second tensioner 134.

The second tensioners 134 are attached to the outer periphery of the cylinder 86 respectively in succession to the first tensioners 114, and each include, as seen from FIGS. 2 and 3, plate member 136 attached to the cylinder 86 by a proper method such as a welding method, screwing method, etc., and two stationary rods 138 and two movable rods 140 which are projectively provided on the plate member 136 at right angles thereto and yet in the same direction and are arranged substantially linearly. The stationary rods 138 and movable rods 140 are alternately disposed. The stationary rod 138 is fixed to the plate member 136 by a known method such as a welding method, screwing method, etc.. The movable rod 140 has a threaded portion 144, and is attached to the plate member 136 by allowing said threaded portion 144 to be inserted, at a desired position, through a slit 142 formed in the plate member 136 and screwing a nut 146 and a lock nut 148 over the projected threaded portion 144. Accordingly, the attachment position of the movable rod 140 is adjusted along said slit 142.

The binding thread 108 passed through the first tensioner 114 is stretched and passed over the rods 138, 140 in a zigzag manner, and thereafter is guided to a guide ring 150. The binding thread 108 is allowed to travel while being allowed to slide on the surface of the rods 138, 140. In order to draw out the binding thread 108 through the second tensioner 134, a force is required which is superior to a frictional force produced by said sliding movement. This force is used as a back tension required to bind the thread 108 about the first element assembly 44. If the movable rods 140 are displaced along the slit 142 thereby to raise the zigzagged degree of a path of the binding thread 108, said frictional force is increased to cause an increase in said back tension.

Said back tension is increased, for example, by the rise of the flyer rotation speed, accordingly by the rise of the travel speed of the binding thread 108. This is because a contact pressure of the binding thread 108 with each of the rods 138, 140 is increased by the rise of the travel speed of the binding thread 108 and said frictional force applied to the binding thread 108 is thus increased.

As above described, the back tensions produced by the first and second tensioners 114 and 134 are mutually oppositely varied with respect to the variation of the flyer rotation speed. Therefore, if both tensioners 114, 134 are each chosen to have an appropriate structural dimension and the binding thread 108 are permitted to pass sequentially through both tensioners 114, 134, the binding thread 108 is given a substantially constant back tension irrespective of the variation of the flyer rotation speed and is bound about the first element assembly. In this embodiment, two rods are used for each of the stationary and movable rods 138,

140 but this rod number can properly be determined in accordance with the conditions of the thread-binding operation. A plurality of totalized binding threads 108 drawn respectively, out of the second tensioners 134 and guide rings 150 are converged by a single guide ring 152 into a single bundle, and this bundle of binding threads is spirally bound by the binding die mounted on the base board 78 about the outer periphery of the first element assembly 44. Although in FIG. 2 the case is shown where said guide ring 152 is singly used and all of the binding threads 108 are bundled into one thread unit, it is possible that another guide ring 153 in addition to said guide ring 152 is used, that is, plurality of guide rings can be used and all of the binding threads 108 are converged thereby into a plurality of bundles and these bundles of binding threads are bound about the primary element assembly 44.

The foregoing description refers to the first high speed binding device 26. The same description applies also to the second high speed binding device 28 excepting that the secondary element assembly 58 in place of the primary element assembly 44 is allowed to travel through the through hole 90 bored in the flyer 84, and applies also to the third high speed binding device 30 excepting that the tertiary element assembly 72 is allowed to travel through said hole 90.

The foregoing description refers to the case where the binding device is used in the stranding machine for manufacturing a multiconductor communication cable consisting of a plurality of conductor layers, but this invention can be applied also to a quadding machine and stranding machine for manufacturing other various types of cables and also to a machine for effecting SZ quadding, SZ pairing, SZ stranding.

What we claim is:

1. A high speed binding device comprising a flyer rotated about its rotation axis and having a through hole bored coaxially with said rotation axis for passing an element assembly therethrough, a cylinder of said flyer extending in the direction of said rotation axis, and a flange of said flyer formed at right angles to said cylinder, a plurality of package holders mounted on said flyer and each having a package having a wound binding thread and each having a package-attaching mechanism fixed to said flyer with a binding thread-winding axis of said package in parallel to said rotation axis of said flyer and suited for drawing out said binding thread in the direction of said winding axis, means provided on said cylinder for each said package holder, for imparting a substantially uniform back tension to each binding thread bound about said element assembly moving through said through hole bored through said cylinder, irrespective of the variation of the rotation speed of said flyer and including a first tensioner for imparting to each said binding thread a back tension which is decreased as the rotation speed of said flyer rises and a second tensioner for imparting to each said binding thread a back tension which is increased as the rotation speed of said flyer rises so as to cancel said decreased amount of back tension, and a binding die for applying the binding threads to said element assembly in cooperation with the rotation of said flyer.

2. A high speed binding device according to claim 1, wherein said package-attaching mechanism includes a nut, an attaching member having a male screw at one end and a threaded hole at the other end and fixed to said flange of said flyer in parallel to the rotation axis of said flyer by screwing said nut over said male screw, and a screw screwed into said threaded hole so as to fix said package fitted over said other end of said attaching member.

3. A high speed binding device according to claim 1, wherein said package holder includes a cover having an opening at its one end so as to draw out said binding thread through said opening.

4. A high speed binding device according to claim 3, wherein said opening is formed in said cover at a position displaced outwardly from said binding thread-winding axis of said package.

5. A high speed binding device according to claim 1, wherein said first tensioner includes a stationary plate fixedly attached to said cylinder of said flyer, a movable plate pressing said stationary plate toward the center of said flyer, said binding thread travelling between said movable and stationary plates, and a spring for pressing said movable plate against said stationary plate with a force greater than a centrifugal force acting on said movable plate due to the rotation of said flyer; and said second tensioner includes a plate member substantially radially projectively provided on said cylinder of said flyer in parallel to said rotation axis of said flyer and a plurality of rods which are projectively provided on said plate member at right angles thereto and in the same direction and over which said binding thread passing through said second tensioner is stretched in a zigzag manner to be drawn out.

6. A high speed binding device according to claim 5, wherein said movable plate partially constituting said first tensioner is slidably fitted over a rod member substantially radially projectively provided on said cylinder of said flyer and is pressed against said stationary plate because of the respective actions of said spring and an adjusting plate which are both fitted over said rod member, said spring abutting on said movable plate at one end, said adjusting plate abutting on the other end of said spring and having its position adjusted by a nut and a lock nut screwed over a threaded portion provided on an end portion of said rod member.

7. A high speed binding device according to claim 5, wherein said rods of said second tensioner consist of a plurality of stationary rods fixed to said plate member and a plurality of movable rods arranged in a manner that said movable rods and stationary rods are alternately disposed, each said movable rod being fixed, by screwing a nut and a lock nut over a threaded portion of said movable rod allowed to project behind a slit formed in said plate member through said slit, at a proper position of said slit, so that a zigzagged travel path of said binding thread can be adjusted in respect of its zigzagged degree.

8. A high speed binding device according to claim 1, which further comprises guide ring means for collecting the plurality of binding threads passed through said tensioner into a prescribed number of bundles to bind said bundles about said element assembly.

9. A high speed binding device according to claim 8, wherein said guide ring means consists of a single guide ring.

10. A high speed binding device according to claim 8, wherein said guide ring means consists of a plurality of guide rings.

* * * * *